United States Patent [19]

Betts

[11] Patent Number: 4,488,486

[45] Date of Patent: Dec. 18, 1984

[54] LOW BRISANCE DETONATING CORD

[76] Inventor: Robert E. Betts, 8107 Hogan Dr., Huntsville, Ala. 35802

[21] Appl. No.: 450,495

[22] Filed: Dec. 16, 1982

[51] Int. Cl.[3] ..... F42B 3/10

[52] U.S. Cl. ..... 102/275.1; 102/275.8

[58] Field of Search ..... 102/275.1, 275.8, 275.3, 102/275.5, 275.6, 275.9, 275.11, 200, 305

[56] References Cited

U.S. PATENT DOCUMENTS 3,411,446 11/1968 Michael ..... 102/275.1
3,590,739 7/1971 Persson ..... 102/275.8 X
3,667,391 6/1972 Amiable et al. ..... 102/275.6 X
3,730,096 5/1973 Prior ..... 102/275.8
4,080,902 3/1978 Goddard et al. ..... 102/275.8 X
4,328,753 5/1982 Kristensen et al. ..... 102/275.8 X

*Primary Examiner*—David H. Brown
*Attorney, Agent, or Firm*—Anthony T. Lane; Robert P. Gibson

[57] ABSTRACT

A low brisance detonating cord including an outer case of explosive material of predetermined detonating velocity and an inner core of explosive material concentrically carried in the outer core. The inner core has a detonating velocity greater than the outer core.

3 Claims, 7 Drawing Figures

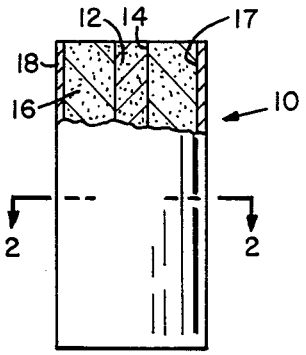
FIG. 1
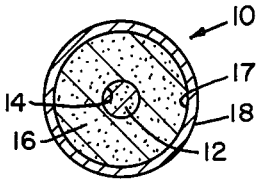
FIG. 2
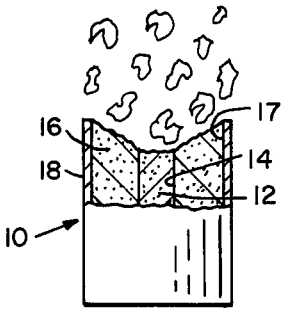
FIG. 3
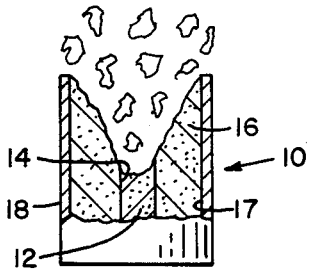
FIG. 4
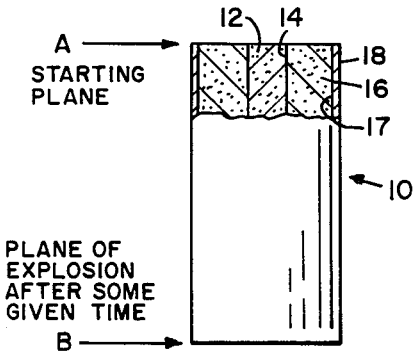
FIG. 5
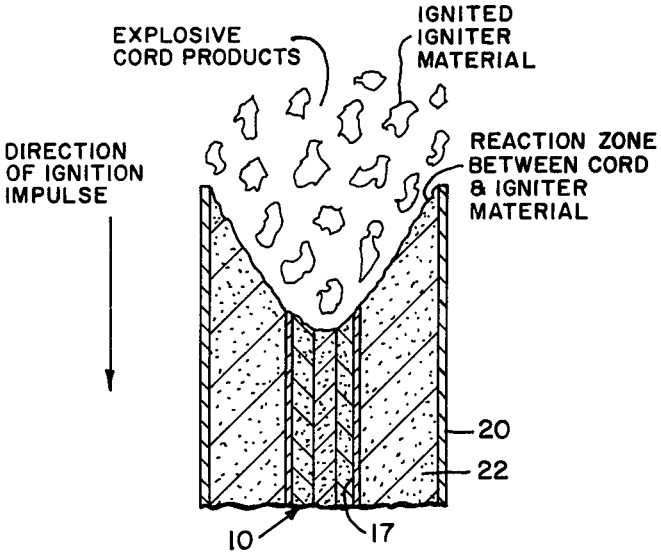
FIG. 7
| CONDITION | DETONATING VELOCITY FT/SEC | | TIME TO REACH B FROM A (MICROSEC) | |
|---|---|---|---|---|
| | INNER CORE | OUTER CORE | INNER CORE | OUTER EDGE OF OUTER CORE |
| 1 | 20,000 | 20,000 | 41.67 | 41.67 |
| 2 | 20,000 | 10,000 | 41.67 | 41.88 |
| 3 | 20,000 | 1,000 | 41.67 | 43.75 |
ASSUME A TO B EQUALS 10 INCHES
INNER CORE DIAMETER = 0.025 INCHES
OUTER CORE DIAMETER = 0.075 INCHES
FIG. 6

LOW BRISANCE DETONATING CORD

DEDICATORY CLAUSE

The invention described herein may be manufactured, used, and licensed by or for the Government for governmental purposes without the payment to me of any royalties thereon.

BACKGROUND OF THE INVENTION

This invention relates to an arrangement of explosives in an explosive detonating cord which will reduce the brisance of the cord yet will not detract from its active velocity. The brisance of detonating cords is dependent upon several factors, three of which are, the type of explosive, the amount of explosives and the detonating velocity. One way of reducing the brisance is reducing the amount of explosives which is expressed by weight of explosive per linear foot. Hence, a core loading of 10 grains per foot has less output and brisance than 15 grains per foot, (All other factors being equal). In some instances where the cord is used to ignite other materials, such as boron potassium nitrate pellets or double-base propellants, the brisance may be so great that the material to be ignited is "blown" away before proper or uniform ignition occurs or the igniter material is crushed resulting in over-ignition. Reducing the core loading will reduce brisance but such a reduction reaches a point in which the amount of explosive is insufficient to do the job. Reducing the velocity will reduce brisance but such a velocity reduction may be too slow for some applications. This invention allows for fast velocities with reduced brisance which also permits fast and uniform ignition of secondary materials.

SUMMARY OF THE INVENTION

A detonating cord of low brisance including an inner or first explosive mounted concentrically in an outer or second explosive. An outer sheath is disposed around the second explosive. The inner explosive has a high detonating velocity (from 10,000 to 21,000 feet per second), and the outer explosive has a lesser velocity than the inner explosive (10,000 to 1,000 feed per second or less).

BRIEF DESCRIPTION OF THE DRAWINGS

FIG. 1 is an elevational view partially in section of the detonating cord of the present invention.

FIG. 2 is a view taken along line 2—2 of FIG. 1.

FIGS. 3 and 4 are elevational views illustrating the shape of the cord at points in time after the cord has been ignited.

FIG. 5 is an elevational view of the detonating cord prior to ignition thereof, and, FIG. 6 is a table, which illustrates with FIG. 5, the relationship of time when the outer front is reached by the detonating wave with differing inner-outer velocity ratios.

FIG. 7 is an elevation sectional view of the detonating cord as used in an igniter.

DESCRIPTION OF THE PREFERRED EMBODIMENT

As seen in FIGS. 1 and 2, a detonating cord 10 includes a first explosive 12 concentrically mounted in a central opening 14 of a second explosive 16 which is encased in an outer sheath 18. Explosive 12 defines an inner core and explosive 16 defines an outer core.

Explosive 12 includes a high detonating velocity (from 10,000 to 20,000 feet per second). Explosive 16 is provided with a lower detonating velocity than explosive 12 (10,000 to 1,000 feet per second, or less). In the figures, the inner explosive is shown to be positioned in the outer explosive without a sheath enclosing the inner explosive. However, if desired a sheath may be used to enclose the inner explosive also. Lead may be used as sheath material. For lightweight applications aluminum may be used and for fast burning applications silver may be resorted to.

After initial cord initiation, the inner core detonates the outer core. FIGS. 3 and 4 illustrate schematically the shape of the cord at a point in time after the end has been initiated. As the difference in velocity between the inner and outer core increases, the angle of the explosive front to reach the outside edge 17 increases (FIG. 4 shows the angle to be greater than FIG. 3). Since the distance across the diameter of the cord is very small compared to the longitudinal length, the time for the explosive front to reach the outside edge 17 at the end of the length traveled, is approximately the velocity of the inner core.

FIG. 5 and the table labeled FIG. 6 show the relationship of time when the outer front is reached by the detonating wave with different inner-outer velocity ratios. For example, assuming an inner core diameter of 0.015 inches and an outer core diameter of 0.045 inches, the following conditions occur: The time for the explosive front to travel across the outer core to the edge 17 of the cord is 0.125 microseconds for a detonating velocity of 10,000 FPS and 1.25 microseconds for 1,000 FPS.

FIG. 7 illustrates the cord as used in an igniter. As seen in FIG. 7 the cord 10 is positioned in an igniter 20 having a material 22 which is to be ignited by cord 10. The time that the reaction zone travels down the igniter lags the inner core velocity by 0.125 microseconds for an outer core velocity of 1,000 FPS; hence linear ignition velocity is maintained by the inner core, and brisance is reduced by using outer core explosives of lower detonating velocity.

External to (not shown) the igniter 20 of FIG. 7, may be a rocket motor which is to be ignited, warhead ordnance which may be dispensed, or other devices requiring low brisance activation.

I claim:

1. A detonating cord of low brisance comprising:

a. An outer core of explosive material of predetermined detonating velocity, and b. An inner core of explosive material concentrically carried in said outer core and in contiguous relationship therewith, said inner core having a detonating velocity higher than that of said outer core, said inner core disposed for transmitting detonation waves of predetermined velocity to said outer core, said outer core being defined by a sheath enclosing a first explosive, and said inner core including a second explosive carried in a central opening of said first explosive.

2. A detonating cord as set forth in claim 1 wherein said detonating velocity of said first explosive is in the range of 10,000 to 21,000 feet per second.

3. A detonating cord as set forth in claim 2 wherein said detonating velocity of said second explosive is in the range of 1,000 to 10,000 feet per second.

* * * * *